US005843587A

United States Patent [19]

Nakamori et al.

[11] Patent Number: 5,843,587

[45] Date of Patent: Dec. 1, 1998

[54] PROCESS FOR TREATING HIGH TEMPERATURE CORROSION RESISTANT COMPOSITE SURFACE

[75] Inventors: Masaharu Nakamori; Kouji Takahashi, both of Hyogo-ken, Japan

[73] Assignee: Mitsubishi Heavy Industries, Ltd., Tokyo, Japan

[21] Appl. No.: 874,252

[22] Filed: Jun. 13, 1997

[51] Int. Cl.[6] ..... C23C 4/08; C23C 4/12; B32B 15/01

[52] U.S. Cl. ..... 428/637; 428/678; 428/937; 427/456

[58] Field of Search ..... 428/629, 633, 428/636, 678, 668, 680, 682, 937, 637, 638; 427/456, 453, 405

[56] References Cited

U.S. PATENT DOCUMENTS 4,585,481 4/1986 Gupta et al. ..... 428/678

5,082,741 1/1992 Taira et al. ..... 428/469

5,302,465 4/1994 Miller et al. ..... 428/552

*Primary Examiner*—John J. Zimmerman

*Attorney, Agent, or Firm*—Foley & Lardner

[57] ABSTRACT

A process for treating a high temperature corrosion resistant composite surface is disclosed. The process includes the steps of forming a first alloy layer by coating a metallic base material with a NiCr alloy or a MCrAlY alloy (M being made of one or more selected from the group consisting of Fe, Ni and Co) with low pressure plasma spraying, forming a second alloy layer on the first alloy layer by coating the first layer with an alloy having identical composition with atmospheric plasma spraying and then subjecting these layers to thermal diffusion treatment in a vacuum furnace or an inert gas atmosphere furnace. Thus, high temperature corrosion resistance is provided for a metallic material used at high temperatures.

8 Claims, 1 Drawing Sheet

PROCESS FOR TREATING HIGH TEMPERATURE CORROSION RESISTANT COMPOSITE SURFACE

BACKGROUND OF THE INVENTION

1. Field of the Invention

This invention relates to a process for providing high temperature corrosion resistance for a metallic material used in a high temperature, and more particularly to a process for treating a high temperature corrosion resistant surface which is suitably used for the moving and stationary blades of a gas turbine, and so on.

2. Description of the Related Art

A tremendous increase has occurred in a gas temperature, even exceeding 1300° C., at the turbine entrance of recent highly efficient industrial gas turbines typically used in combined cycle plants. Active research and development have been made for practical alloys to be used for the moving and stationary blades which are exposed to such high temperature gas, and the operating temperature has been increasing year by year. However, for practical alloys, the temperature is still limited to the level of 850° to 900° C. Accordingly, for an actual gas turbine, a thin, internal air-cooling blade is used.

For fuel to be used, research has been made on the utilization of LNG, by-product gas or fuel oil, and recently even on the use of coal by liquefying or gasifying it. Accordingly, the air-cooling blade has been coated with a corrosion resistant alloy made of NiCoCrAlY or CoCrAlY by low pressure plasma spraying (referred to as VPS, hereinafter) in order to prevent its high temperature oxidation or high temperature corrosion.

In the gas turbine in which the operating temperature is high, the rates of oxidization and corrosion increases following an increase in a gas temperature in the moving and stationary blades which come into direct contact with the combustion gas. Even when corrosion resistant coating like that described above is applied, the introduction of a high temperature corrosive component with fuel or combustion air causes conspicuous damages. Under these circumstances, a surface treating process providing much higher resistance to high temperature corrosion is required.

It is an object of the present invention made with the foregoing technical level and requirement in mind to present a surface treating process which provides much higher resistance to high temperature corrosion.

SUMMARY OF THE INVENTION

According to the present invention, there is disclosed a process for treating a high temperature corrosion resistant composite surface, characterized in that a first alloy layer is formed by coating a metallic base material used at a high temperatures with a NiCr alloy or a MCrAlY alloy (M being made of one or more selected from the group consisting of Fe, Ni and Co) which is deposited by low pressure plasma spraying, a second alloy layer is formed by coating the first alloy layer with an alloy having identical composition, which is deposited by atmospheric plasma spraying, and then these layers are subjected to thermal diffusion treatment in a vacuum or in inert gas atmosphere in a furnace.

More particularly, in order to provide high temperature corrosion resistance for a metallic base material to be used at high temperatures (simply referred to as a base material, hereinafter) represented by Fe, Ni or Co-based alloy, the surface treating process of the present invention includes the following steps:

(1) the material to be treated (base material) is coated with a NiCr alloy or a MCrAlY alloy (M being made of one or more selected from the group consisting of Fe, Ni and Co) by low pressure plasma spraying;

(2) the layer formed in step (1) is coated with an alloy having identical composition by normal atmospheric plasma spraying; and (3) by performing thermal diffusion treatment between the coated layer and the base material and between the coated layers in vacuum or in inert gas (Ar, $N_2$, etc.) in a furnace, excellent adhesion, uniformity and resistance to high temperature corrosion are provided for the layers.

Table 1 shows the general conditions of low pressure plasma and atmospheric plasma spraying for a NiCr alloy or a MCrAlY alloy on a high temperature metallic material used in a high temperature and the general range of coated layer thickness. The NiCr alloy and the MCrAlY alloy are sprayed under the same conditions.

TABLE 1

| | | Low pressure plasma spraying | | | Atmospheric |
|---|---|---|---|---|---|
| Item | Division | Cleaning | Preheating | Thermal spraying | plasma spraying |
| Chamber | (mbar) | 30–40 | 45–55 | 55–65 | None (in atmosphere) |
| Spray distance | (mm) | 250–275 | 290–320 | 270–280 | 100–150 |
| Ar flow rate | (liter/min) | 50–60 | 45–55 | 40–50 | 30–60 |
| $H_2$ flow rate | (liter/min) | 0 | 7–9 | 8–10 | 8–10 |
| Current | (Amp) | 490–510 | 590–610 | 670–700 | 500–800 |
| Voltage | (V) | 58–62 | 60–65 | 62–67 | 35–40 |
| Powder feed | (%) | — | — | 12–16 | 4–8(Kg/Hr) |
| Transfer current | (A) | 45–55 | — | — | — |
| Carrier gas flow rate | (liter/min) | — | 1.8–2.0 | 1.8–2.0 | — |
| General coated layer thickness | | | 100–300 $\mu$m | | 100–500 $\mu$m |

General conditions for thermal diffusion treatment performed in the vacuum furnace or in inert gas atmosphere furnace after low pressure plasma spraying and atmosphere spraying are respectively as follows.

Vacuum furnace: 900° to 1150° C., 2 to 24 hours 10 to 50 Torr ($N_2$ or Ar atmosphere)

Inert gas atmosphere furnace: 900° to 1150° C., 2 to 24 hours atmospheric pressure to 2 ata. (Ar or $H_2$ atmosphere)

The NiCr alloy or the MCrAlY alloy and the base material constitutional element plasma-sprayed by low pressure are mutually diffused and thus adhesion between the base material and the coated layer is maintained. In addition, since the surface of the layer formed by low pressure plasma spraying has proper surface roughness necessary for atmospheric plasma spraying, blasting as treatment performed prior to atmospheric plasma spraying is made unnecessary. Accordingly, the intrusion of a foreign matter such as a blasting material or the like can be prevented between low pressure plasma spraying and atmospheric plasma spraying. Further, the formation of layers by low pressure and atmospheric plasma spraying makes it possible to prevent peeling caused by a thermal expansion coefficient difference between these two sprayed layers.

The surface of an atmospheric plasma spraying particle is oxidized during spraying and covered by an oxide ($Cr_2O_3$, $Al_2O_3$, and so on) coating film. Since this oxide coating film has excellent resistance against corrosion caused by fused salt or corrosive gas, the progress of corrosion can be controlled. The layer formed by atmospheric plasma spraying has through-holes. The intrusion of a corrosive component (e.g., gas of oxygen, and so on, or liquid of fuel ash, and so on) through such holes produces corrosion (internal oxidation or corrosion) in the boundary with a material to be treated. This corrosion may cause peeling of the sprayed layers. However, in the case of the present invention, since the layer coated with a NiCr alloy or a MCrAlY alloy having excellent resistance to oxidation and corrosion by low pressure plasma spraying is used as a substrate for the layer formed by atmospheric plasma spraying, the progress of such internal oxidation or corrosion is retarded and thus peeling of the sprayed layers can be controlled.

With its actual use, cracks may occur in the coated layer which contains a large amount of Cr or Cr·Al. These cracks may result in the great reduction of a base material strength. In the case of the present invention, however, such cracks occur only in the layer formed by atmospheric plasm spraying and thus adverse effects on the base material can be prevented.

DETAILED DESCRIPTION OF THE PREFERRED EMBODIMENTS

The effects of the present invention will become more apparent with reference to the following specific examples.

Example 1

Figure 1:
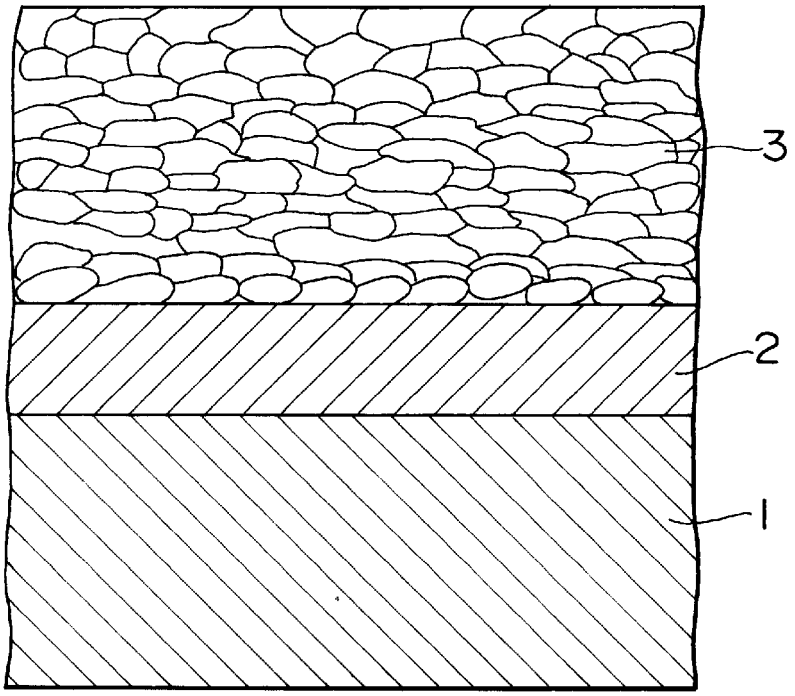
FIG. 1 is a section view of a composite surface treated layer of Example 1 of the present invention.

Referring to FIG. 1, a reference numeral 1 denotes a base material, which is composed of a gas turbine moving blade Ni-based alloy IN738LC (by wt. %, its composition is Co: 8.3, Cr: 15.9, Ti: 1.75, W: 2.54, Ta: 1.73, C: 0.09. Al: 3.42, Zr: 0.03, B: 0.008, Fe: 0.1, Si<0.05, Mn<0.05, S<0.005 and Ni: remaining part). This base material 1 was subjected to blasting by alumina and then installed in a low pressure plasma spraying canister (simply referred to as a spraying canister, hereinafter). Then, a low pressure plasma-sprayed layer was formed by applying a 50 Ni–50 Cr alloy 2 with low pressure plasma spraying so as to have a film thickness of 100 $\mu$m. Then, after dry air was introduced in the spraying canister, an atmospheric plasma-sprayed layer was formed by applying a 50 Ni–50 Cr alloy 3 with atmospheric plasma spraying so as to have a film thickness of 500 $\mu$m. After spraying was over, thermal diffusion treatment of 1050° C.×4 hours was performed in an Ar gas atmosphere furnace. The conditions for such low pressure and atmospheric plasma spraying are shown in Table 2, later described.

Example 2

Figure 2:
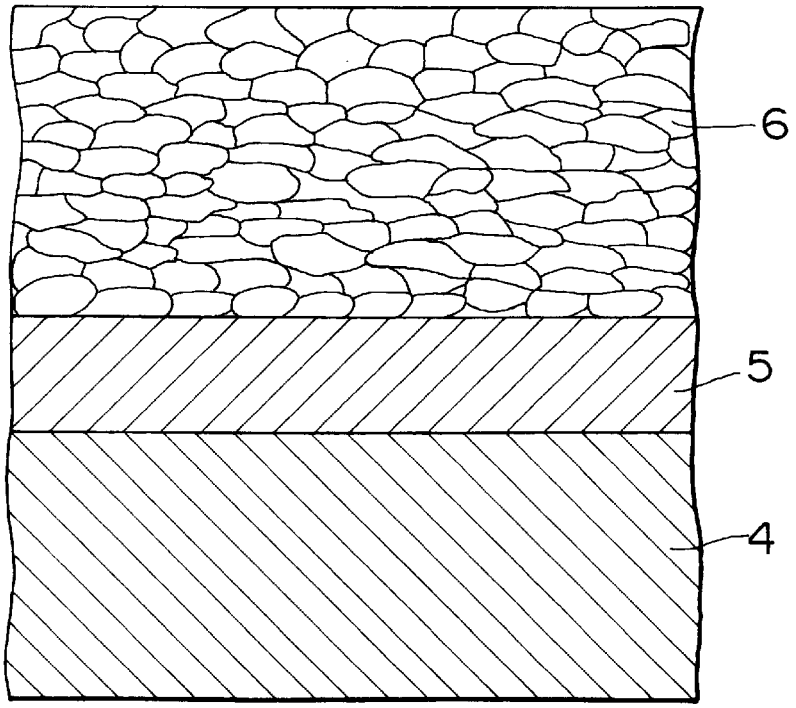
FIG. 2 is a section view of a composite surface treated layer of Example 2 of the present invention.

Referring to FIG. 2, a reference numeral 4 denotes a base material, which is composed of a gas turbine stationary blade Co-based alloy ECY768 (by wt. %, its composition is Cr: 23.5, Ni: 9.86, Ti: 0.22, W: 7.18, Ta: 3.75, C: 0.61, Al: 0.21, Zr: 0.01, B: 0.001, Fe: 0.06, Si<0.1, Mn<0.1, S<0.001 and Co: remaining part). The base material 4 was subjected to blasting by alumina and then installed in the spraying canister. Then, a low pressure plasma-sprayed layer was formed by applying a Co—30 wt. % Cr—8 wt. % Al—0.5 wt. % alloy 5 with low pressure plasma spraying so as to have a film thickness of 200 $\mu$m. Then, after dry air was introduced in the spraying canister, an atmospheric plasma-sprayed layer was formed by applying a Co—30 Wt. % Cr—8 wt. % Al—0.5 wt. % Y alloy 6 with atmospheric plasma spraying so as to have a film thickness of 300 $\mu$m. After spraying was over, thermal diffusion treatment of 1150° C.×2 hours was performed in a vacuum furnace.

The conditions of the low pressure and atmospheric plasma spraying described in the foregoing Examples 1 and 2 are shown below in the Table 2.

TABLE 2

| | | Low pressure plasma spraying | | | Atmospheric |
|---|---|---|---|---|---|
| Item | Division | Cleaning | Preheating | Thermal spraying | plasma spraying |
| Chamber | (mbar) | 30 | 55 | 60 | — |
| Spray distance | (mm) | 260 | 300 | 280 | 120 |
| Ar flow rate | (liter/min) | 50 | 50 | 50 | 40 |
| $H_2$ flow rate | (liter/min) | 0 | 8 | 10 | 8 |
| Current | (Amp) | 500 | 600 | 650 | 600 |
| Voltage | (V) | 60 | 62 | 65 | 40 |
| Powder feed | (%) | — | — | 12 | 5(Kg/Hr) |
| Transfer current | (A) | 50 | — | — | |
| Carrier gas flow rate | (liter/min) | — | 2.0 | 2.0 | — |
| Coated layer thickness | | Example 1 | 50Ni50Cr | 100 $\mu$m | 500 $\mu$m |
| | | Example 2 | CoCrAlY | 200 $\mu$m | 300 $\mu$m |

Comparison Example

By using the test pieces obtained in the Examples 1 and 2 and test pieces (base materials: IN738LC and ECY768) coated with a 50 wt. % Ni—50 wt. % Cr alloy and a Co—30 wt. % Cr—8 wt. % Al—0.5 wt. % Y alloy by singly performing low pressure plasma spraying or atmospheric plasma spraying so as to have a film thickness of 500 $\mu$m, evaluation was made for corrosion resistance by a $Na_2SO_4$—$V_2O_5$ synthetic ash coating high temperature corrosion test and for adhesion by a heat cycle test performed by repeating 1150° C. and RT (room temperature).

(1) Result of the Synthetic Ash Coating High Temperature Corrosion Test

Referring to Table 3, it can be understood that as compared with the low pressure plasma-sprayed material of the Comparison Example, the corrosion reduction rates in the Examples 1 and 2 of the present invention were about 60% for 50 Ni–50 Cr and about 65% for CoCrAlY respectively.

On the other hand, as compared with the atmospheric plasma-sprayed material, the rates were almost equal or slightly smaller. In evaluation made in terms of maximum erosion depth, the result was almost the same as that in the case of corrosion reduction rate. In the Table 3, in the evaluation of the corrosion testing result by low pressure plasma spraying, the corrosion reduction rate and the maximum erosion depth of the test piece coated with a 50 Ni–50 Cr alloy are shown being set to 100 respectively.

TABLE 3

RESULT OF SYNTHETIC ASH COATING HIGH TEMPERATURE CORROSION TEST

| Method of execution | Example 1 | Example 2 | Low pressure plasma spraying | | Atmospheric plasma spraying | |
|---|---|---|---|---|---|---|
| Coating material | 50Ni—50Cr | CoCrAlY | 50Ni—50Cr | CoCrAlY | 50Ni—50Cr | CoCrAlY |
| Evaluation | | | | | | |
| Corrosion reduction rate | 57 | 52 | 100 | 80 | 60 | 56 |
| Maximum erosion depth | 60 | 56 | 100 | 82 | 65 | 58 |

*1 For 50Ni—50Cr, a base material (material to be treated) was IN738LC.
For CoCrAlY (Co - 30 Cr - 8Al - 0.5Y), a base material was ECY768.
*2 Test conditions
Synthetic ash: 80 wt. % $Na_2SO_4$ - 20 wt. % $V_2O_5$
Atmosphere: $N_2$ —$CO_2$—$O_2$—$SO_2$ mixed gas
Temperature: 850° C.
Time: 100 hr
*3 For evaluation, the values of the test piece coated with 50Ni—50Cr by low pressure plasma spraying were respectivety set to 100.

(2) Result of the Heat Cycle Test

Referring to Table 4 which shows the gist of a test result, it can be understood that no special abnormality except slight color changes occurred in the test pieces of the Examples 1 and 2 as in the case of the low pressure plasma-sprayed material while cracks or peeling occurred in the atmospheric plasma-sprayed material.

TABLE 4

RESULT OF HEAT CYCLE TEST

| Method of execution | Coating material (base material) | Test result |
|---|---|---|
| Example 1 | 50Ni-50Cr (IN738LC) | Appearance was black, but no abnormality, such as cracks or peeling, occurred. |
| Example 2 | Co-30Cr-8A1-0.5Y (ECY768) | No abnormality. |
| Low pressure plasma spraying | 50Ni-50Cr (IN738LC) | Appearance was slightly black, but no abnormality occurred. |
| | Co-30Cr-8A1-0.5Y (ECY768) | No abnormality. |
| Atmospheric plasma spraying | 50Ni-50Cr (IN738LC) | Small cracks occurred after 5 cycles. Cracks gradually increased in size after 6 cycles and partial peeling occurred after 10 cycles. |
| | Co-30Cr-8A1-0.5Y (ECY768) | Cracks occurred at 1 cycle. Small peeling occurred after 5 cycles. Peeling range expanded after 10 cycles. |

Heat cycle condition: atmosphere=air 1150° C. (15 min.) ≠RT (room temperature) 10 cycles The process for treating a high temperature corrosion resistant composite surface of the present invention is remarkably effective for industrial purpose in that excellent high temperature corrosion resistance can be provided for a metallic material used in a high temperature.

What is claimed is:

1. A surface treatment process for producing a high temperature corrosion resistant composite surface, comprising the steps of:

forming a first alloy layer by coating a metallic base material to be used at high temperatures with at least one of a NiCr alloy and a MCrAlY alloy, wherein M is at least one metal selected from the group consisting of Fe, Ni and Co using low pressure plasma spraying;

forming a second alloy layer on said first alloy layer by coating said first alloy layer with an alloy having identical composition, using atmospheric pressure plasma spraying; and subjecting said first and second layers to thermal diffusion treatment in at least one of a vacuum furnace and an inert gas atmosphere furnace.

2. A surface treatment process as claimed in claim 1, wherein said metallic base material used in a high temperature is a Ni-based alloy, and the resultant treated article is a gas turbine moving blade.

3. A surface treatment process as claimed in claim 1, wherein said metallic base material used in a high temperature is a Co-based alloy, and the resultant treated article is a gas turbine stationary blade.

4. A surface treatment process as claimed in claim 1, wherein said first alloy layer has a thickness of about 100–300 $\mu$m.

5. A surface treatment process as claimed in claim 1, wherein said second alloy layer has a thickness of about 100–500 $\mu$m.

6. A surface treatment process as claimed in claim 1, wherein said thermal diffusion treatment in a vacuum furnace is effected at about 900°–1150° C., for about 2–24 hours, at about 10–50 Torr, in a nitrogen or argon atmosphere.

7. A surface treatment process as claimed in claim 1, wherein said thermal diffusion treatment in an inert gas atmosphere furnace is effected at about 900°–1150° C., for about 2–24 hours, at about 1–2 atmospheres pressure, in an argon or hydrogen gas atmosphere.

8. A high temperature corrosion resistant composite material, produced by forming a first alloy layer on a surface of a metallic base material to be used at high temperatures, by low pressure plasma spraying, forming a second alloy layer on said first alloy layer by coating said first alloy layer with an alloy having identical composition by atmospheric pressure plasma spraying, and then subjecting said first and second alloy layers to thermal diffusion treatment in at least one of a vacuum furnace and an inert gas atmosphere furnace, wherein said first alloy layer comprises at least one of a NiCr alloy and a MCrAlY alloy, wherein M is at least one metal selected from the group consisting of Fe, Ni and Co.

* * * * *